US008514160B2

(12) United States Patent
Huang et al.

(10) Patent No.: US 8,514,160 B2
(45) Date of Patent: Aug. 20, 2013

(54) DISPLAY AND DISPLAY PANEL THEREOF

(75) Inventors: Yu-Sheng Huang, Kaohsiung County (TW); Ya-Ling Hsu, Taipei County (TW); Hung-Lung Hou, Changhua County (TW)

(73) Assignee: Au Optronics Corporation, Hsinchu (TW)

( * ) Notice: Subject to any disclaimer, the term of this patent is extended or adjusted under 35 U.S.C. 154(b) by 501 days.

(21) Appl. No.: 12/787,406

(22) Filed: May 26, 2010

(65) Prior Publication Data

US 2011/0241526 A1 Oct. 6, 2011

(30) Foreign Application Priority Data

Apr. 1, 2010 (TW) ..... 99110141 A

(51) Int. Cl.
*G09G 3/36* (2006.01)

(52) U.S. Cl.
USPC ..... 345/92; 345/93; 345/55

(58) Field of Classification Search
USPC ..... 345/92–93, 55
See application file for complete search history.

(56) References Cited

U.S. PATENT DOCUMENTS

| | | | | |
|---|---|---|---|---|
| 6,552,706 | B1 | 4/2003 | Ikeda et al. | |
| 6,809,719 | B2 | 10/2004 | Wu et al. | |
| 2003/0218586 | A1 | 11/2003 | Wu et al. | |
| 2005/0068283 | A1* | 3/2005 | Tseng | 345/93 |
| 2005/0263772 | A1* | 12/2005 | Park | 257/72 |
| 2007/0164958 | A1 | 7/2007 | Edwards | |
| 2008/0068524 | A1 | 3/2008 | Kim | |

FOREIGN PATENT DOCUMENTS

| | | | |
|---|---|---|---|
| CN | 1669068 | A | 9/2005 |
| CN | 101226290 | A | 7/2008 |
| CN | 201266288 | Y | 7/2009 |
| JP | 2001-033757 | | 2/2001 |

OTHER PUBLICATIONS

"First Office Action of China Counterpart Application", issued on Jul. 12, 2012, pp. 1-5.

* cited by examiner

*Primary Examiner* — William Boddie
*Assistant Examiner* — Leonid Shapiro
(74) *Attorney, Agent, or Firm* — Jianq Chyun IP Office

(57) ABSTRACT

A display panel including a plurality of scan lines, a plurality of data lines, and a plurality of pixels is provided. The data lines are disposed substantially perpendicular to the scan lines Each of the pixels is electrically connected with the corresponding data line and the corresponding scan line and the pixels are arranged as an array. The data lines are grouped into a plurality of groups and each of the groups is disposed between two adjacent pixel columns and has N data lines, where N is a positive integer greater than or equal to 3. A portion of the data lines of at least a first group among the groups cross over a portion of the scan lines. The rest data lines of the first group cross over all the scan lines.

9 Claims, 11 Drawing Sheets

DISPLAY AND DISPLAY PANEL THEREOF

CROSS-REFERENCE TO RELATED APPLICATION

This application claims the priority benefit of Taiwan application serial no. 99110141, filed on Apr. 1, 2010. The entirety the above-mentioned patent application is hereby incorporated by reference herein and made a part of specification.

BACKGROUND OF THE INVENTION

1. Field of the Invention

The present invention generally relates to a display and a display panel thereof, and more particularly, to a display with reduced crosstalk and a display panel thereof.

2. Description of Related Art

In recent years, many portable electronic products and flat panel display products have been developed along with the advancement of semiconductor technology. Among different types of flat panel displays, liquid crystal display (LCD) has become the mainstream of display products thanks to its many advantages, such as low-voltage operation, no scattering radiation, light weight, and small volume.

FIG. 1 is a diagram of a display panel of a conventional LCD. As shown in FIG. 1, each pixel P of the display panel 100 is coupled to a corresponding scan line 110 and a corresponding data line 120 through an active device (i.e., a thin film transistor (TFT)) TR, and only one data line 120 is disposed between every two pixel columns. In other words, the pixels in the same column share the same data line 120. Besides, the frame rate of the LCD illustrated in FIG. 1 is usually 60 Hz (i.e., the frame is updated 60 times during every second), wherein the greater the frame rate is, the higher image quality the LCD has.

In order to improve the display quality of dynamic images, LCDs with frame rates of 120 Hz and 240 Hz have been brought into the market. However, the charge time of each pixel P decreases along with the increase of the frame rate, wherein the charge time=(1/frame rate)/total number of scan lines. For example, assuming that the display panel 100 has a resolution of 1920*1080 (full HD) and is applied to an LCD with a frame rate of 120 Hz, the charge time of each pixel P is then 1/(120*1080)≈7 us. In this case, the charge time of each pixel P is still within an acceptable range. However, if the frame rate is increased, the charge time of each pixel P will be too short and thus causing that each of the pixels P is charged insufficiently.

To be specific, assuming that the display panel 100 also has a resolution of 1920*1080 but is applied to an LCD with a frame rate of 240 Hz, the charge time of each pixel P becomes 1/(240*1080)≈3.5 us. Because the charge time is too short, each pixel P cannot be charge to the appropriate voltage level and accordingly cannot display the correct grayscale (i.e., image distortion). As a result, the image quality of the LCD is reduced. Accordingly, a driving technique referred to as "half gate, two data (hG2D)" is developed.

Referring to FIG. 2, the display panel 200 is fabricated by adopting the hG2D driving technique, wherein two data lines 210 are disposed between every two pixel columns As shown in FIG. 2, in each pixel column, two adjacent pixels P are coupled to different data lines 210. Thus, two pixel rows are charged together during the same scan period. Namely, the charge time of each pixel P in the display panel 200 is twice that of each pixel P in the display panel 100.

For example, assuming that the display panel 200 has a resolution of 1920*1080 and is applied to an LCD with a frame rate of 240 Hz, the charge time of each pixel P is then 2*1/(240*1080)≈7 us. Accordingly, the problem of inadequate charge time of each pixel P produced when a full HD display panel is applied to an LCD with the frame rate of 240 Hz is resolved. However, this problem will be produced again if the frame rate is further increased or the resolution of the display panel is increased.

FIG. 3 and FIG. 4 are respectively diagrams of LCD panels disclosed in U.S. Pat. No. 6,809,719 and U.S. publication No. 20080068524. As described above, if the frame rate or resolution is higher than that of the display panel 200 (for example, the frame rate is 360 Hz or 480 Hz or the resolution is 4K2K (i.e., 3840*2160)), the charge time of each pixel P won't be adequate even though it is prolonged twice. Thus, the charge time of each pixel P is prolonged in the display panels 300 and 400 disclosed in the U.S. Pat. No. 6,809,719 and the U.S. publication No. 20080068524.

In the display panel 300, each pixel P includes a liquid crystal capacitor $C_L$ and a storage capacitor $C_S$, and three data lines 310 are disposed between every two pixel columns. Thus, in each pixel column, every three adjacent pixels P are respectively coupled to different data lines 310 so that three pixel rows can be charged together during the same scan period. Accordingly, the charge time of each pixel P in the display panel 300 is three times of that of each pixel P in the display panel 100. In the display panel 400, four data lines 410 are disposed between every two pixel columns. Thus, in each pixel column, every four adjacent pixels P are respectively coupled to different data lines 410 so that four pixel rows can be charged together during the same scan period. Accordingly, the charge time of each pixel P in the display panel 400 is four times of that of each pixel P in the display panel 100.

As described above, the driving technique adopted by the display panel 300 may be considered as a 3-data driving technique, and the driving technique adopted by the display panel 400 may be considered as a 4-data driving technique. However, in foregoing display panels 300 and 400, some pixels P have to cross over other data lines 310 or 410 to be coupled to the corresponding data lines 310 or 410 (as the place A and the place B illustrated in FIG. 3 and FIG. 4). Herein, lines (i.e. data lines) crossing may result in unnecessary cross-over capacitances and accordingly the crosstalk may be produced to cause the local frame producing the color washout. In addition, a 4-sided driving technique has to be adopted if the pixels P are not to be coupled to the data lines 310 or 410 through lines crossing in the 3-data or 4-data driving technique. Namely, the control boards would be disposed respectively at the upper and lower side of the display panel. As a result, the cost of the display panel is increased.

SUMMARY OF THE INVENTION

Accordingly, the present invention is directed to a display panel, wherein the charge time of each pixel is prolonged.

The present invention is also directed to a display, wherein lines crossing can be avoided so that crosstalk of a display panel can be prevented.

The present invention provides a display panel including a plurality of scan lines, a plurality of data lines, and a plurality of pixels. The data lines are disposed substantially perpendicular to the scan lines. Each of the pixels is electrically connected to the corresponding data line and the corresponding scan line and the pixels are arranged as an array. The data lines are grouped into a plurality of groups. Each of the groups is disposed between two adjacent pixel columns and has N data lines, where N is a positive integer greater than or equal to 3. A portion of the data lines of at least a first group among the groups cross over a portion of the scan lines, and the rest data lines of the first group cross over all the scan lines.

The present invention also provides a display including a display panel and a backlight module. The backlight module provides a light source to the display panel. The display panel includes a plurality of scan lines, a plurality of data lines, and a plurality of pixels. The data lines are disposed substantially perpendicular to the scan lines. Each of the pixels is electrically connected to the corresponding data line and the corresponding scan line and the pixels are arranged as an array. The data lines are grouped into a plurality of groups, and each of the groups is disposed between two adjacent pixel columns and has N data lines, where N is a positive integer greater than or equal to 3. A portion of the data lines of at least a first group among the groups cross over a portion of the scan lines, and the rest data lines of the first group cross over all the scan lines.

According to an embodiment of the present invention, the first group includes a first data line, a second data line, and a third data line when N is 3. The first data line crosses over the portion of the scan lines to receive a first data signal and transmit the first data signal to a portion of even pixels in a first pixel column of the two adajcent pixel columns corresponding to the first group. The second data line crosses over the portion of the scan lines to receive a second data signal and transmit the second data signal to a portion of odd pixels in a second pixel column of the two ajdacent pixel columns corresponding to the first group. The third data line crosses over all the scan lines to receive a third data signal and transmit the third data signal to the rest even pixels in the first pixel column and the rest odd pixels in the second pixel column.

According to an embodiment of the present invention, the portion of the even pixels in the first pixel column do not cross over the second data line and the third data line to receive the first data signal; the portion of the odd pixels in the second pixel column do not cross over the first data line and the third data line to receive the second data signal; and the rest even pixels in the first pixel column and the rest odd pixels in the second pixel column do not cross over the first data line and the second data line to receive the third data signal.

According to an embodiment of the present invention, the first group includes a first data line, a second data line, a third data line, and a fourth data line when N is 4. The first data line crosses over the portion of the scan lines to receive a first data signal and transmit the first data signal to a portion of even pixels in a first pixel column of the two adjacent pixel columns corresponding to the first group. The second data line crosses over the portion of the scan lines to receive a second data signal and transmit the second data signal to a portion of odd pixels in a second pixel column of the two adjacent pixel columns corresponding to the first group. The third data line crosses over all the scan lines to receive a third data signal and transmit the third data signal to the rest even pixels in the first pixel column. The fourth data line crosses over all the scan lines to receive a fourth data signal and transmit the fourth data signal to the rest odd pixels in the second pixel column.

According to an embodiment of the present invention, the portion of the even pixels in the first pixel column do not cross over the second data line, the third data line, and the fourth data line to receive the first data signal; the portion of the odd pixels in the second pixel column do not cross over the first data line, the third data line, and the fourth data line to receive the second data signal; the rest even pixels in the first pixel column do not cross over the first data line, the second data line, and the fourth data line to receive the third data signal; and the rest odd pixels in the second pixel column do not cross over the first data line, the second data line, and the third data line to receive the fourth data signal.

According to an embodiment of the present invention, the first group includes a first data line, a second data line, a third data line, and a fourth data line when N is 4. The first data line crosses over the portion of the scan lines to receive a first data signal and transmit the first data signal to a portion of even pixels in a first pixel column of the two adjacent pixel columns corresponding to the first group. The second data line crosses over the portion of the scan lines to receive a second data signal and transmit the second data signal to a portion of even pixels in a second pixel column of the two adjacent pixel columns corresponding to the first group. The third data line crosses over all the scan lines to receive a third data signal and transmit the third data signal to the rest even pixels in the first pixel column. The fourth data line crosses over all the scan lines to receive a fourth data signal and transmit the fourth data signal to the rest even pixels in the second pixel column.

According to an embodiment of the present invention, the portion of the even pixels in the first pixel column do not cross over the second data line, the third data line, and the fourth data line to receive the first data signal; the portion of the even pixels in the second pixel column do not cross over the first data line, the third data line, and the fourth data line to receive the second data signal; the rest even pixels in the first pixel column do not cross over the first data line, the second data line, and the fourth data line to receive the third data signal; and the rest even pixels in the second pixel column do not cross over the first data line, the second data line, and the third data line to receive the fourth data signal.

According to an embodiment of the present invention, the first group includes a first data line, a second data line, a third data line, and a fourth data line when N is 4. The first data line crosses over the portion of the scan lines to receive a first data signal and transmit the first data signal to a portion of odd pixels in a first pixel column of the two adjacent pixel columns corresponding to the first group. The second data line crosses over the portion of the scan lines to receive a second data signal and transmit the second data signal to a portion of odd pixels in a second pixel column of the two ajdacent pixel columns corresponding to the first group. The third data line crosses over all the scan lines to receive a third data signal and transmit the third data signal to the rest odd pixels in the first pixel column. The fourth data line crosses over all the scan lines to receive a fourth data signal and transmit the fourth data signal to the rest odd pixels in the second pixel column.

According to an embodiment of the present invention, the portion of the odd pixels in the first pixel column do not cross over the second data line, the third data line, and the fourth data line to receive the first data signal; the portion of the odd pixels in the second pixel column do not cross over the first data line, the third data line, and the fourth data line to receive the second data signal; the rest odd pixels in the first pixel column do not cross over the first data line, the second data line, and the fourth data line to receive the third data signal, and the rest odd pixels in the second pixel column do not cross over the first data line, the second data line, and the third data line to receive the fourth data signal.

According to an embodiment of the present invention, the $i^{th}$ scan line is electrically connected to all the pixels in the $i^{th}$ pixel row to correspondingly receive a scan signal, where i is a positive integer.

As described above, the present invention provides a display and a display panel thereof. A plurality of data lines of the display panel are grouped into a plurality of groups, and the data lines in each of the groups are adjacent to each other and do not cross over any pixel. In each of the groups, a portion of the data lines cross over a portion of the scan lines, and the rest data lines cross over all the scan lines. Thus, each of the pixels in each pixel column is coupled to a portion of data lines in two groups, and the pixels are directly coupled to the data lines without crossing. Thereby, the production of cross-over capacitances caused by lines crossing can be avoided, and accordingly the crosstalk to cause the local frame producing the color washout further could be prevented.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
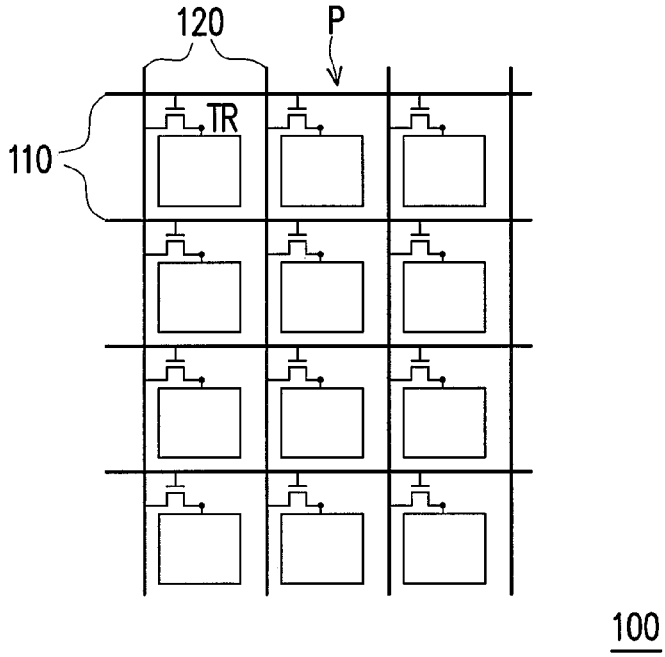
FIG. 1 (RELATED ART)
FIG. 1 and FIG. 2 are respectively diagrams of conventional liquid crystal display (LCD) panels.
Figure 2:
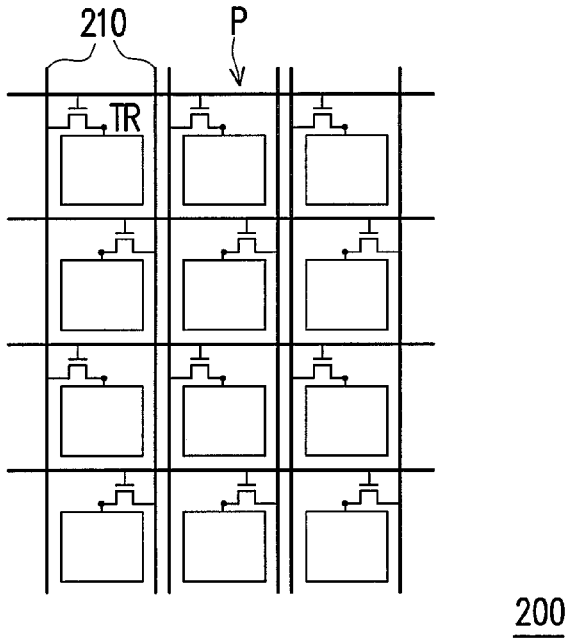
FIG. 2 (RELATED ART)
Figure 3:
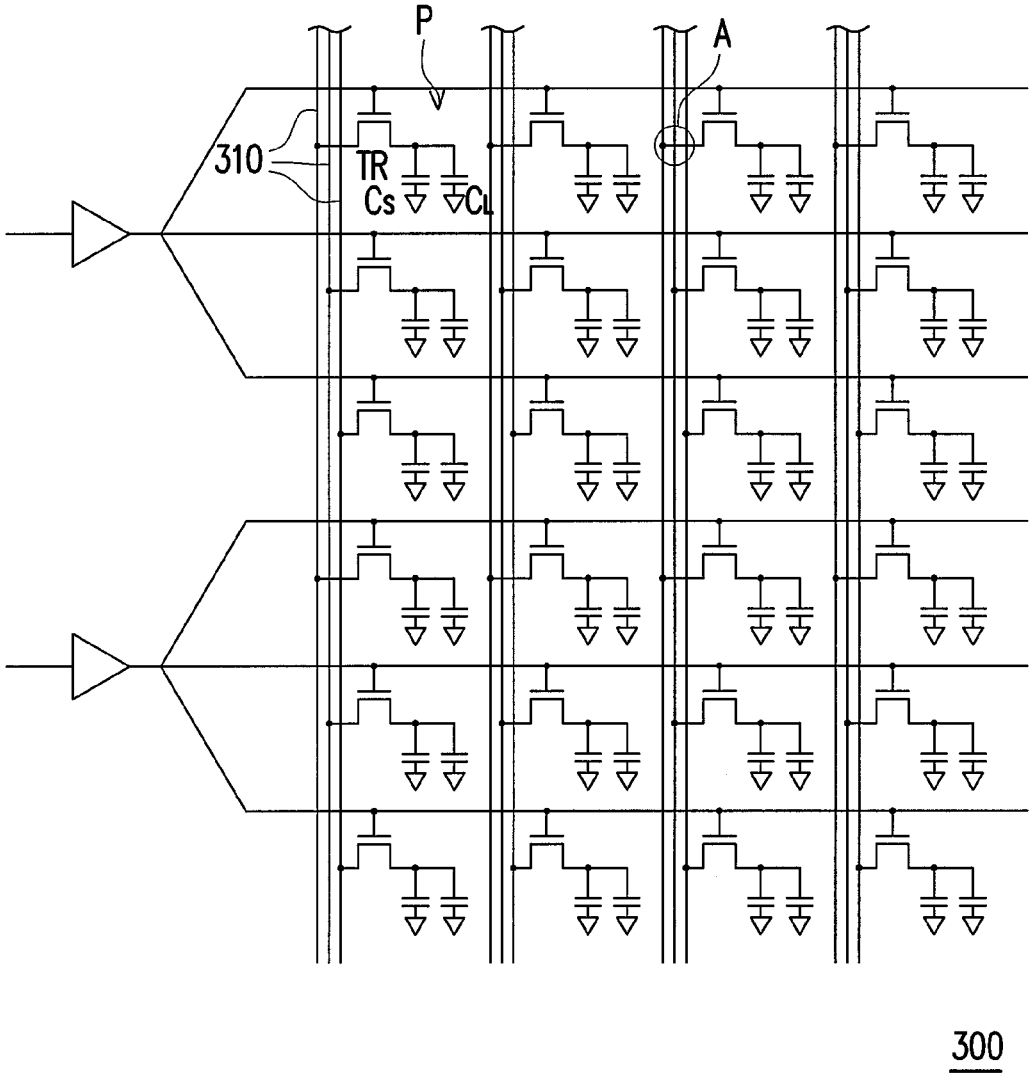
FIG. 3 (RELATED ART)
FIG. 3 and FIG. 4 are respectively diagrams of LCD panels disclosed in U.S. Pat. No. 6,809,719 and U.S. publication No. 20080068524.
Figure 4:
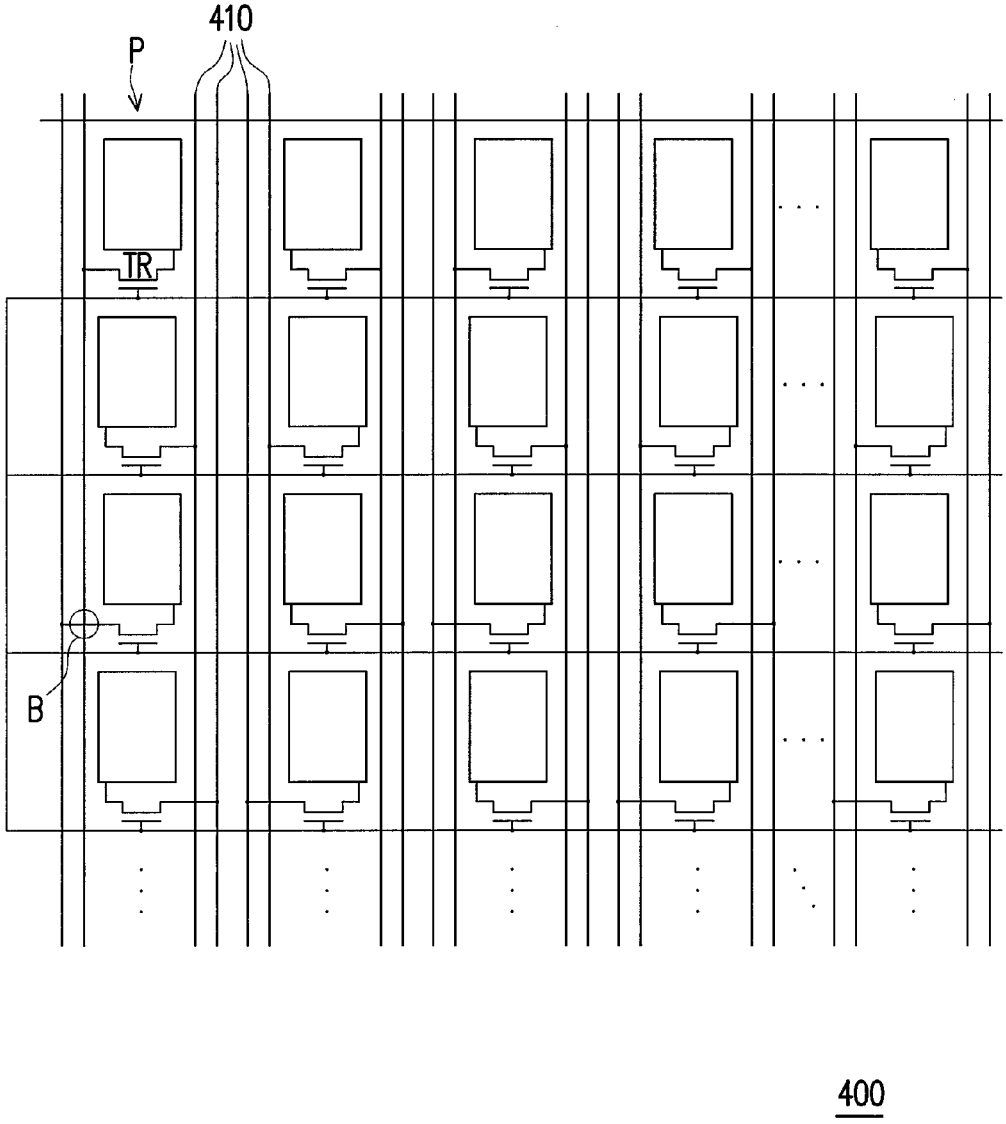
FIG. 4 (RELATED ART)

Reference will now be made in detail to the present preferred embodiments of the invention, examples of which are illustrated in the accompanying drawings. Wherever possible, the same reference numbers are used in the drawings and the description to refer to the same or like parts.

Figure 5A:
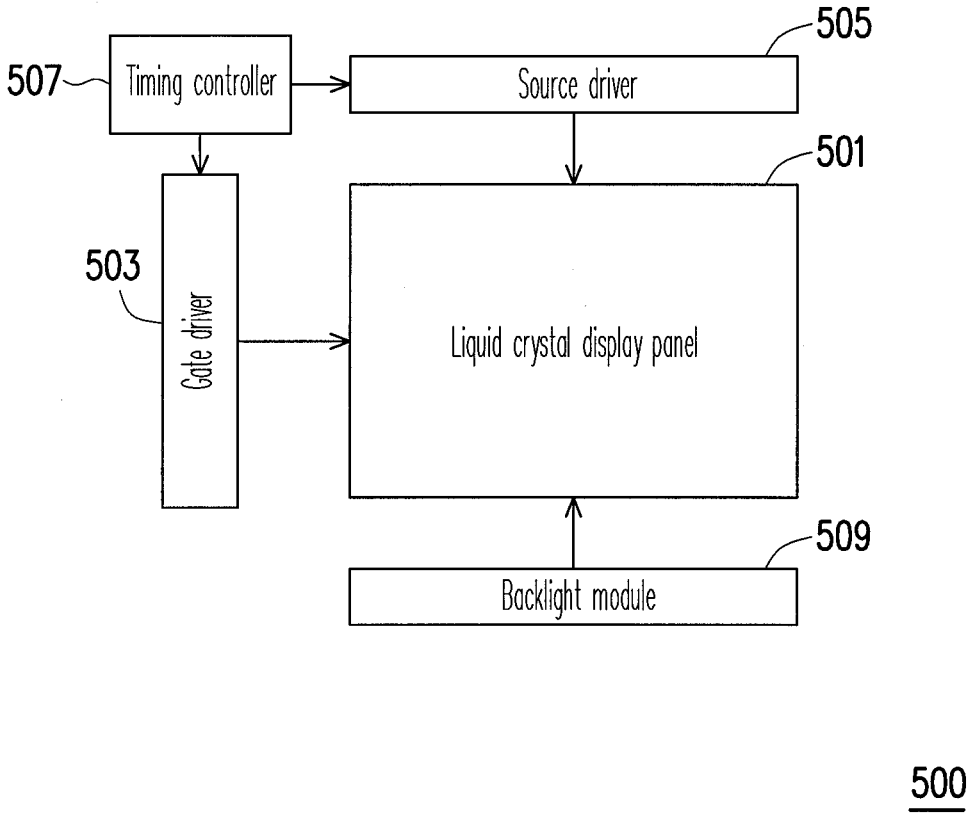
FIG. 5A is a system block diagram of a display 500 according to an embodiment of the present invention.

FIG. 5A is a system block diagram of a display 500 according to an embodiment of the present invention. Referring to FIG. 5A, the display 500 comprises a display panel 501, a gate driver 503, a source driver 505, a timing controller (T-con) 507, and a backlight module 509. The display 500 may be a thin film transistor (TFT) LCD, and correspondingly, the display panel 501 is a TFT display panel.

The backlight module 509 provides a light source to the display panel 501. The T-con 507 controls the operations of the gate driver 503 and the source driver 505 so that the gate driver 503 and the source driver 505 respectively generate scan signals and data signals for driving the display panel 501.

Figure 5B:
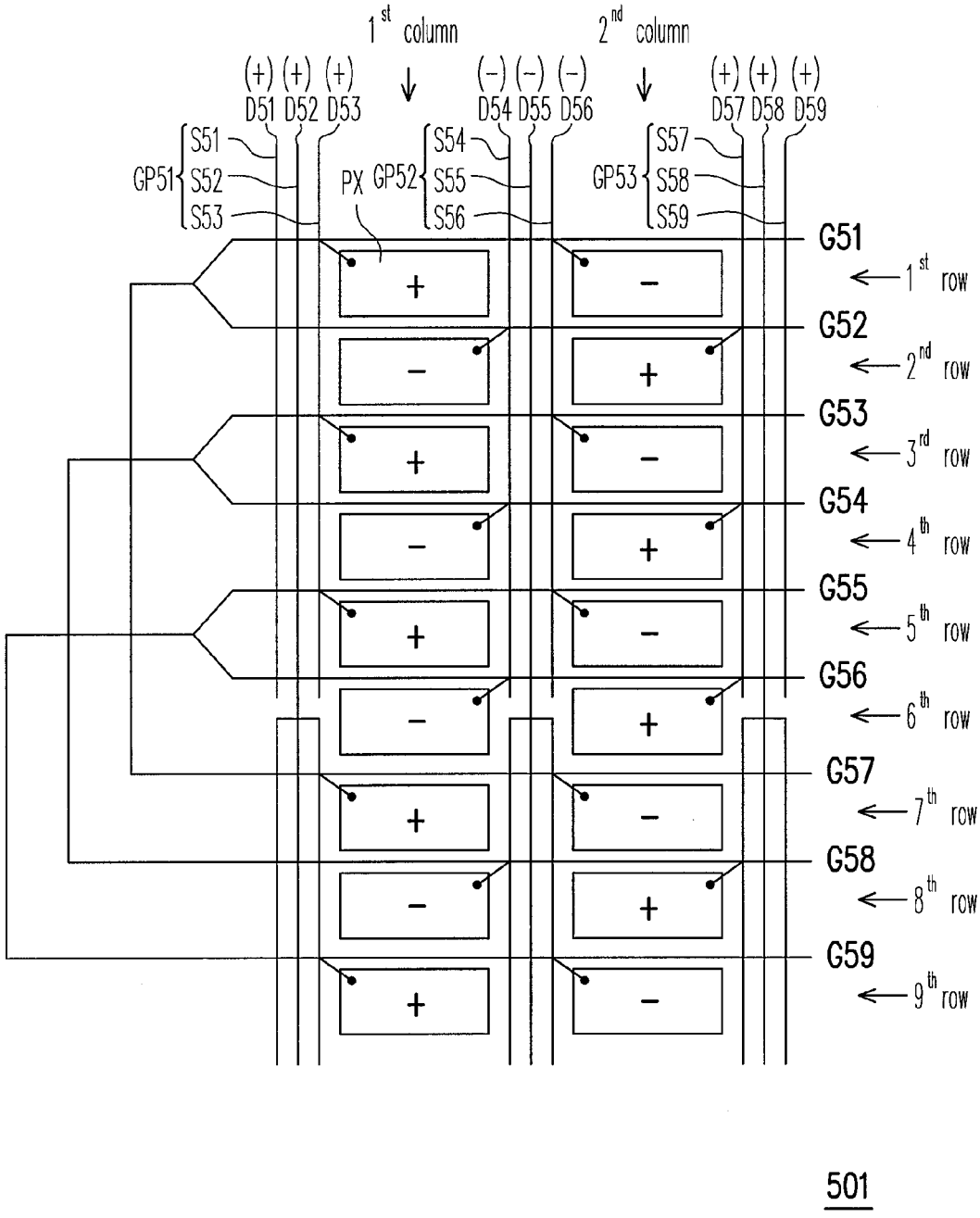
FIG. 5B is a diagram illustrating the structure of an LCD panel 501 according to an embodiment of the present invention.

FIG. 5B is a diagram illustrating the structure of an LCD panel 501 according to an embodiment of the present invention. Referring to both FIG. 5A and FIG. 5B, the display panel 501 includes a plurality of scan lines G51-G59, a plurality of data lines S51-S59, and a plurality of pixels PX arranged as an array. The numbers of the scan lines and the data lines illustrated in FIG. 5B are only examples but not intended to limit the actual structure of the display panel 501, and the numbers of the scan lines and the data lines are not limited in the present invention.

The data lines S51-S59 are disposed substantially perpendicular to the scan lines G51-G59. The scan line G51 is electrically connected to all the pixels PX in the $1^{st}$ pixel row, and the scan line G52 is electrically connected to all the pixels PX in the $2^{nd}$ pixel row. Similarly, the rest scan lines G53-G59 are respectively electrically connected to all the pixels PX in the $3^{rd}$-$9^{th}$ pixel rows. Besides, the scan lines G51, G52, and G57 receive the same scan signal, the scan lines G53, G54, and G58 receive the same scan signal, and the scan lines G55, G56, and G59 receive the same scan signal, which will be described in detail later on.

As shown in FIG. 5B, the data lines S51-S59 are grouped into groups GP51, GP52, and GP53. The group GP51 has the data lines S51-S53, the group GP52 has the data lines S54-S56, and the group GP53 has the data lines S57-S59. In the present embodiment, the group GP52 is disposed between the first pixel column and the adjacent second pixel column. In the group GP51, the data line S51 crosses over the scan lines G51-G56 to receive a data signal D51, the data line S52 crosses over the scan lines G51-G59 to receive a data signal D52 and transmit the data signal D52 to the odd pixels in the $7^{th}$-$9^{th}$ rows of the first pixel column adjacent to the group GP51, and the data line S53 crosses over the scan lines G51-G56 to receive a data signal D53 and transmit the data signal D53 to the odd pixels in the $1^{st}$-$6^{th}$ rows of the first pixel column.

In the group GP52, the data line S54 crosses over the scan lines G51-G56 to receive a data signal D54 and transmit the data signal D54 to the even pixels in the $1^{st}$-$6^{th}$ rows of the first pixel column adjacent to the group GP52. The data line S55 crosses over the scan lines G51-G59 to receive a data signal D55 and transmit the data signal D55 to the even pixels in the $7^{th}$-$9^{th}$ rows of the first pixel column adjacent to the group GP52 and the odd pixels in the $7^{th}$-$9^{th}$ rows of the second pixel column. The data line S56 crosses over the scan lines G51-G56 to receive a data signal D56 and transmit the data signal D56 to the odd pixels in the $1^{st}$-$6^{th}$ rows of the second pixel column.

In the group GP53, the data line S57 crosses over the scan lines G51-G56 to receive a data signal D57 and transmit the data signal D57 to the even pixels in the $1^{st}$-$6^{th}$ rows of the second pixel column adjacent to the group GP53. The data line S58 crosses over the scan lines G51-G59 to receive a data signal D58 and transmit the data signal D58 to the even pixels in the $7^{th}$-$9^{th}$ rows of the second pixel column. The data line S59 crosses over the scan lines G51-G56 to receive a data signal D59.

As described above, the odd pixels in the $1^{st}$-$6^{th}$ rows of the first pixel column are directly coupled to the data line S53 to receive the data signal D53 and do not cross over the data line S51 and S52. The odd pixels in the $7^{th}$-$9^{th}$ rows of the first pixel column are directly coupled to the data line S52 to receive the data signal D52 and do not cross over the data line S51 and S53. The even pixels in the $1^{st}$-$6^{th}$ rows of the first pixel column are directly coupled to the data line S54 to receive the data signal D54 and do not cross over the data line S55 and S56. The odd pixels in the $1^{st}$-$6^{th}$ rows of the second pixel column are directly coupled to the data line S56 to receive the data signal D56 and do not cross over the data line S54 and S55.

On the other hand, the even pixels in the $7^{th}$-$9^{th}$ rows of the first pixel column and the odd pixels in the $7^{th}$-$9^{th}$ rows of the second pixel column are directly coupled to the data line S55 to receive the data signal D55 and do not cross over the data line S54 and S56. The even pixels in the $1^{st}$-$6^{th}$ rows of the second pixel column are directly coupled to the data line S57 to receive the data signal D57 and do not cross over the data line S58 and S59. The even pixels in the $7^{th}$-$9^{th}$ rows of the second pixel column are directly coupled to the data line S58 to receive the data signal D58 and do not cross over the data line S57 and S59. Accordingly, lines (i.e. data lines) crossing can be avoided and thus reducing the crosstalk caused by cross-over capacitances.

Figure 5C:
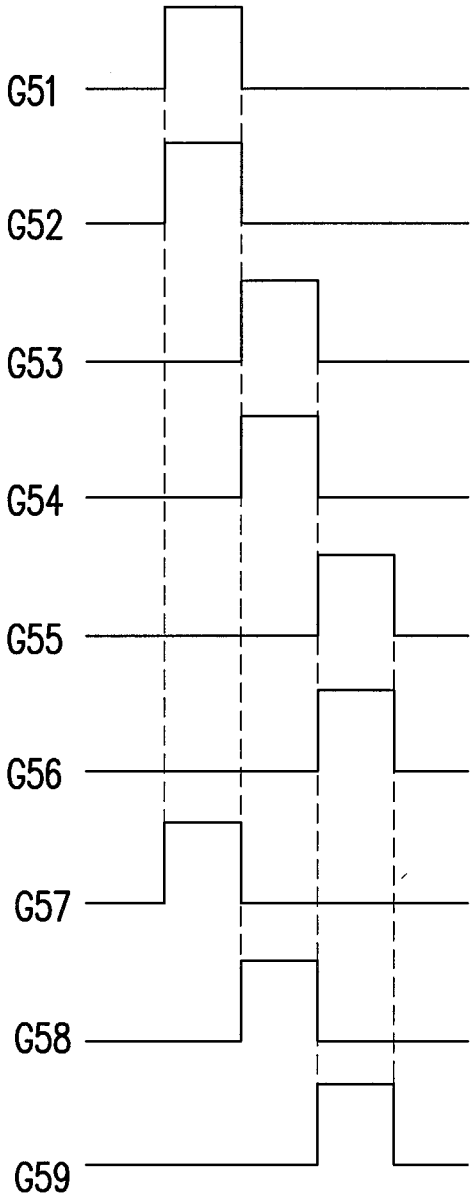
FIG. 5C is a diagram illustrating a driving waveform of the LCD panel 501 according to an embodiment of the present invention.

FIG. 5C is a diagram illustrating a driving waveform of the LCD panel 501 according to an embodiment of the present invention. Referring to both FIG. 5B and FIG. 5C, as described above, the scan lines G51, G52, and G57 receive the same scan signal, the scan lines G53, G54, and G58 receive the same scan signal, and the scan lines G55, G56, and G59 receive the same scan signal. Thus, the pixels PX coupled to the scan lines G51, G52, and G57 are turned on at the same time. At this time, the pixels PX in the first pixel row respectively receive the data signals D53 and D56, the pixels PX in the second pixel row respectively receive the data signals D54 and D57, and the pixels PX in the seventh pixel row respectively receive the data signals D52 and D55.

Thereafter, the pixels PX coupled to the scan lines G53, G54, and G58 are turned on at the same time. At this time, the pixels PX in the third pixel row respectively receive the data signals D53 and D56, the pixels PX in the fourth pixel row respectively receive the data signals D54 and D57, the pixels PX in the eighth pixel row respectively receive the data signals D55 and D58. After that, the pixels PX coupled to the scan lines G55, G56, and G59 are turned on at the same time. At this time, the pixels PX in the fifth pixel row respectively receive the data signals D53 and D56, the pixels PX in the sixth pixel row respectively receive the data signals D54 and D57, and the pixels PX in the ninth pixel row respectively receive the data signals D52 and D55. Thereby, three pixel rows are turned on together during the same scan period, so that the charge time of each pixel PX is prolonged and accordingly the pixel PX can display the correct grayscale.

For example, when the display panel 501 is a full HD display panel, 1080 scan lines are disposed in the display panel 501. In this case, the $1^{st}$-$720^{th}$ scan lines of the display panel 501 are considered a scan area, and two rows of the pixels coupled to the $1^{st}$-$720^{th}$ scan lines are turned on during each scan period. In addition, the $721^{st}$-$1080^{th}$ scan lines of the display panel 501 are considered another scan area, and one row of the pixels coupled to the $721^{st}$-$1080^{th}$ scan lines are turned on during each scan period. Thus, three pixel rows are turned on during each scan period, so that the charge time of each pixel PX could be prolonged to three times of that in a conventional driving tehcnique.

Moreover, if the display panel 501 is driven through column inversion, the pixels PX coupled to the data lines S51-S59 do not adjoin each other and are respectively seperated by a pixel PX, and the pixels PX coupled to the data lines of the same group are located at different positions in different pixel columns. As shown in FIG. 5B, if the data signals D51-D53 and D57-D59 are positive and the data signals D54-D56 are negative during the current frame period, it is considered that the display panel 501 is driven through dot inversion. Besides, the polarity of the data signals D51-D59 is simply switched during the next frame period. Thus, during a frame period, the polarity of the data signals D51-D59 remains unchanged so that the power consumed for switching the polarity of the data signals is reduced and accordingly the power consumption of the entire display 500 is reduced.

Figure 5D:
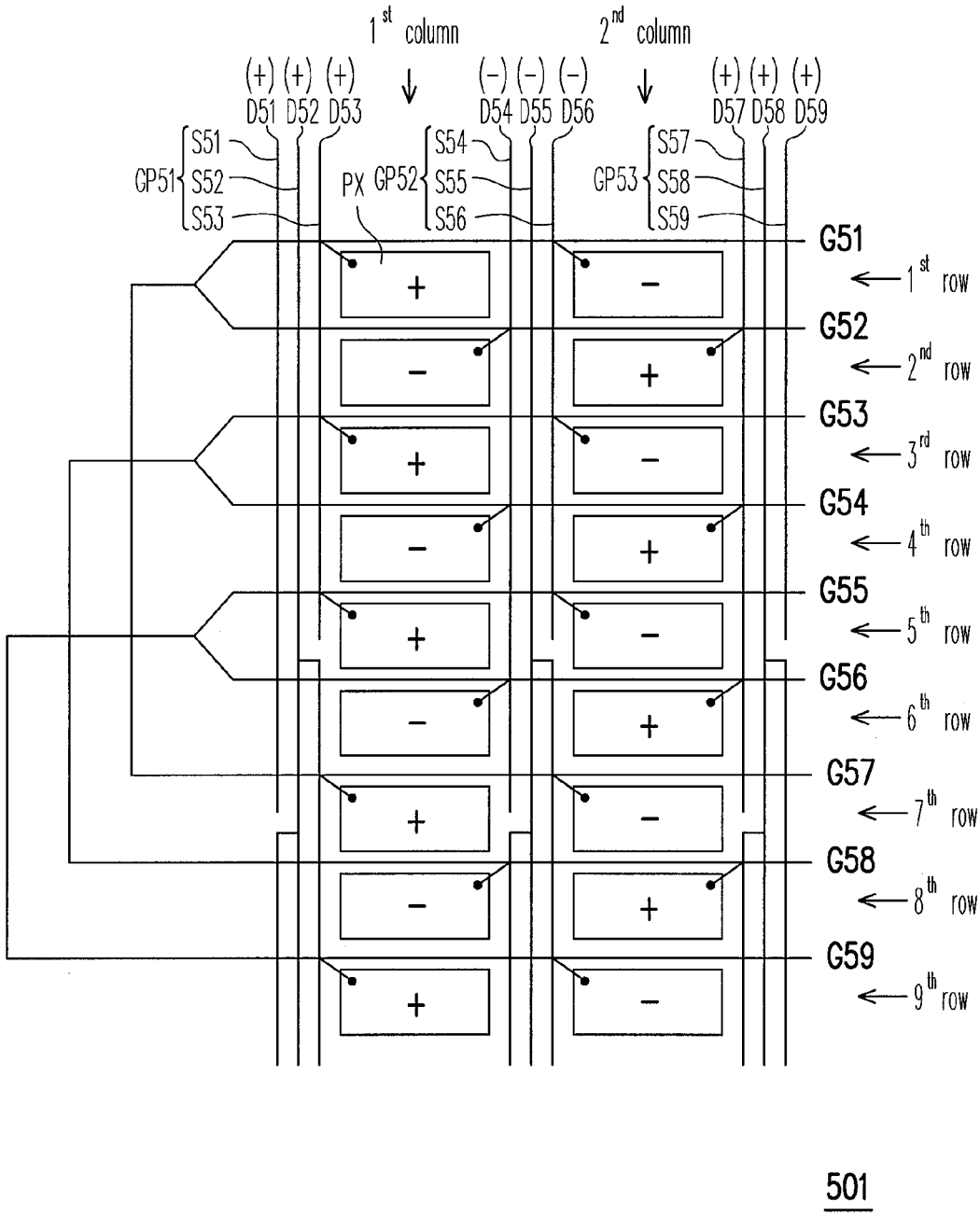
FIG. 5D is a diagram illustrating the structure of an LCD panel 501 according to another embodiment of the present invention.

FIG. 5D is a diagram illustrating the structure of an LCD panel 501 according to another embodiment of the present invention. Referring to FIG. 5B and FIG. 5D, the major difference between the two display panels 501 illustrated in FIG. 5B and FIG. 5D falls on the break points of the data lines S51, S53, S54, S56, S57, and S59. In the present embodiment, the break point of the data line S51 is located between the scan lines G57 and G58, the break point of the data line S53 is located between the scan lines G55 and G56, the break point of the data line S54 is located between the scan lines G57 and G58, the break point of the data line S56 is located between the scan lines G55 and G56, the break point of the data line S57 is located between the scan lines G57 and G58, and the break point of the data line S59 is located between the scan lines G55 and G56. Thereby, unbalanced equivalent capacitance caused by the data lines S51-S59 is reduced.

Figure 6A:
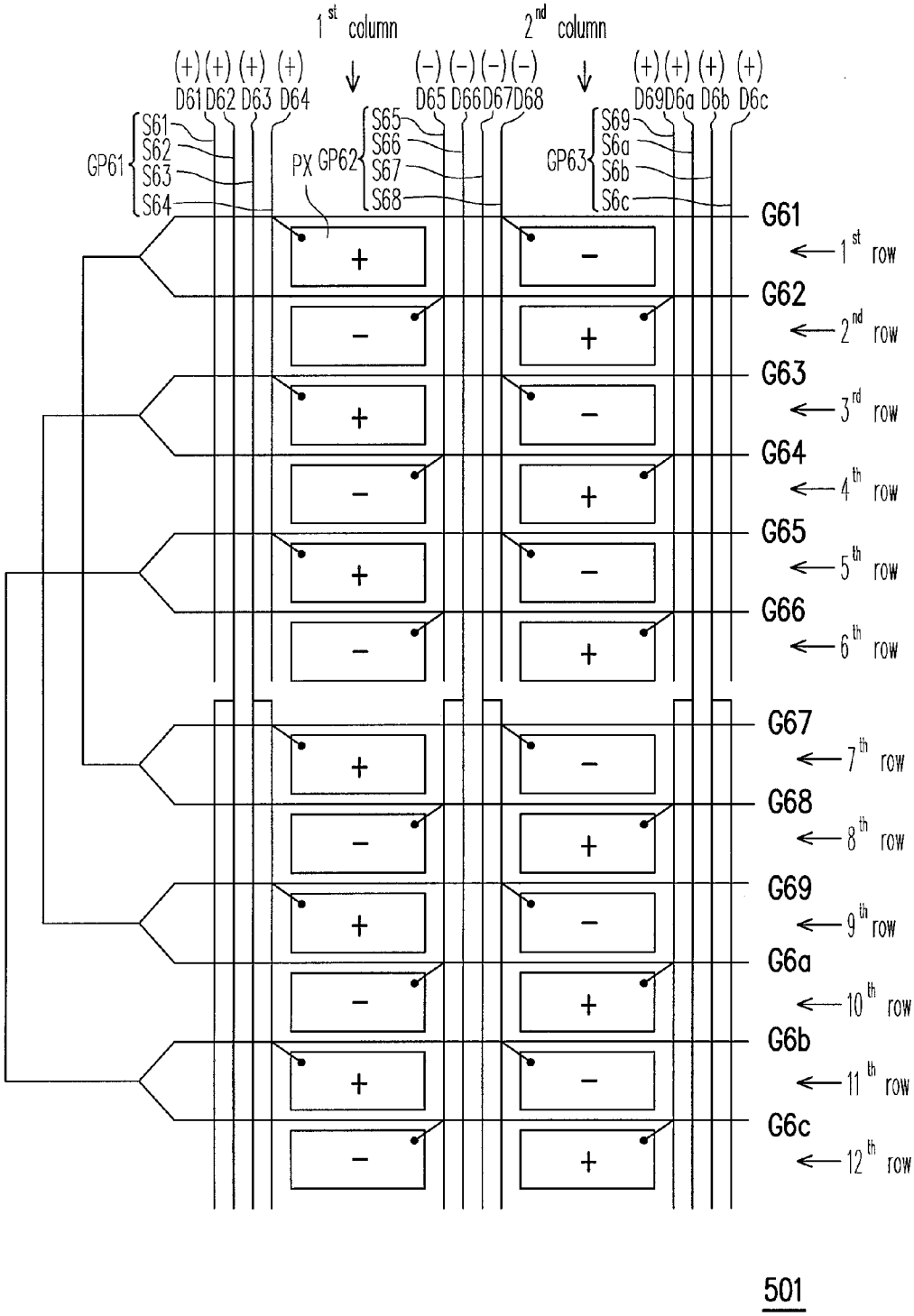
FIG. 6A is a diagram illustrating the structure of an LCD panel 501 according to yet another embodiment of the present invention.

FIG. 6A is a diagram illustrating the structure of an LCD panel 501 according to yet another embodiment of the present invention. Referring to both FIG. 5A and FIG. 6A, the display panel 501 includes a plurality of scan lines G61-G69 and G6*a*-G6*c*, a plurality of data lines S61-S69 and S6*a*-S6*c*, and a plurality of pixels PX arranged as an array. The numbers of the scan lines and the data lines illustrated in FIG. 6A are only examples but not intended to limit the actual structure of the display panel 501, and the numbers of the scan lines and the data lines are not limited in the present invention. The data lines S61-S69 and S6*a*-S6*c* are disposed substantially perpendicular to the scan lines G61-G69 and G6*a*-G6*c*.

The scan line G61 is electrically connected to all the pixels PX in the first pixel row, and the scan line G62 is electrically connected to all the pixels PX in the second pixel row. Similarly, the rest scan lines G63-G69 and G6*a*-G6*c* are respectively electrically connected to all the pixels PX in the $3^{rd}$-$12^{th}$ pixel rows. Besides, the scan lines G61, G62, G67, and G68 receive the same scan signal, the scan lines G63, G64, G69, and G6*a* receive the same scan signal, and the scan lines G65, G66, G6*b*, and G6*c* receive the same scan signal.

As shown in FIG. 6A, the data lines S61-S69 and S6*a*-S6*c* are grouped into groups GP61, GP62, and GP63. The group GP61 has the data lines S61-S64, the group GP62 has the data lines S65-S68, and the group GP63 has the data lines S69 and S6*a*-S6*c*. In the present embodiment, the group GP62 is disposed between the first pixel column and the adjacent second pixel column.

In the group GP61, the data line S61 crosses over the scan lines G61-G66 to receive a data signal D61. The data line S62 crosses over the scan lines G61-G69 and G6*a*-G6*c* to receive a data signal D62. The data line S63 crosses over the scan lines G61-G69 and G6*a*-G6*c* to receive a data signal D63 and transmit the data signal D63 to the odd pixels in the $7^{th}$-$12^{th}$ rows of the first pixel column. The data line S64 crosses over the scan lines G61-G66 to receive a data signal D64 and transmit the data signal D64 to the odd pixels in the $1^{st}$-$6^{th}$ rows of the first pixel column adjacent to the group GP61.

In the group GP62, the data line S65 crosses over the scan lines G61-G66 to receive a data signal D65 and transmit the data signal D65 to the even pixels in the $1^{st}$-$6^{th}$ rows of the first pixel column adjacnet to the group GP62. The data line S66 crosses over the scan lines G61-G69 and G6*a*-G6*c* to receive a data signal D66 and transmit the data signal D66 to the even pixels in the $7^{th}$-$12^{th}$ rows of the first pixel column. The data line S67 crosses over the scan lines G61-G69 and G6*a*-G6*c* to receive a data signal D67 and transmit the data signal D67 to the odd pixels in the $7^{th}$-$12^{th}$ rows of the second pixel column adjacent to the group GP62. The data line S68 crosses over the scan lines G61-G66 to receive a data signal D68 and transmit the data signal D68 to the odd pixels in the $1^{st}$-$6^{th}$ rows of the second pixel column.

In the group GP63, the data line S69 crosses over the scan lines G61-G66 to receive a data signal D69 and transmit the data signal D69 to the even pixels in the $1^{st}$-$6^{th}$ rows of the second pixel column adjacent to the group GP63. The data line S6*a* crosses over the scan lines G61-G69 and G6*a*-G6*c* to receive a data signal D6*a* and transmit the data signal D6*a* to the even pixels in the $7^{th}$-$12^{th}$ rows of the second pixel column. The data line S6*b* crosses over the scan lines G61-G69 and G6*a*-G6*c* to receive a data signal D6*b*. The data line S6*c* crosses over the scan lines G61-G66 to receive a data signal D6*c*. As shown in FIG. 6A, the pixel structure illustrated in FIG. 6A is considered a zigzag TFT arrangement. Namely, the active devices (not shown) of the pixels PX in each column are sequentially disposed as "left/right/left/right . . . " from top to bottom.

As described above, the odd pixels in the $1^{st}$-$6^{th}$ rows of the first pixel column are directly coupled to the data line S64 to receive the data signal D64 and do not cross over the data lines S61-S63. The odd pixels in the $7^{th}$-$12^{th}$ rows of the first pixel column are directly coupled to the data line S63 to receive the data signal D63 and do not cross over the data line S61, S62, and S64. The even pixels in the $1^{st}$-$6^{th}$ rows of the first pixel column are directly coupled to the data line S65 to receive the data signal D65 and do not cross over the data lines S66-S68. The even pixels in the $7^{th}$-$12^{th}$ rows of the first pixel column are directly coupled to the data line S66 to receive the data signal D66 and do not cross over the data line S65, S67, and S68. The odd pixels in the $1^{st}$-$6^{th}$ rows of the second pixel column are directly coupled to the data line S68 to receive the data signal D68 and do not cross over the data lines S65-S67.

On the other hand, the odd pixels in the $7^{th}$-$12^{th}$ rows of the second pixel column are directly coupled to the data line S67 to receive the data signal D67 and do not cross over the data line S65, S66, and S68. The even pixels in the $1^{st}$-$6^{th}$ rows of the second pixel column are directly coupled to the data line S69 to receive the data signal D69 and do not cross over the data lines S6*a*-S6*c*. The even pixels in the $7^{th}$-$12^{th}$ rows of the second pixel column are directly coupled to the data line S6*a* to receive the data signal D6*a* and do not cross over the data line S69, S6*b*, and S6*c*. Thereby, lines crossing can be avoided and thus redcuing the crosstalk caused by cross-over capacitances.

Figure 6B:
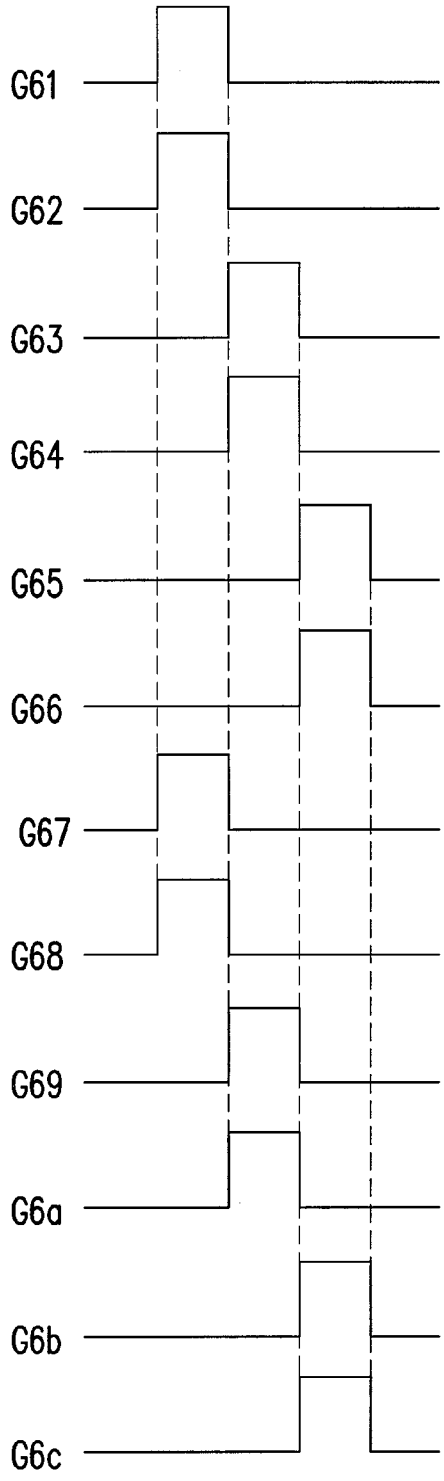
FIG. 6B is a diagram illustrating a driving waveform of the LCD panel 501 according to still another embodiment of the present invention.

FIG. 6B is a diagram illustrating a driving waveform of the LCD panel 501 according to still another embodiment of the present invention. Referring to both FIG. 6A and FIG. 6B, as described above, the scan lines G61, G62, G67, and G68 receive the same scan signal, the scan lines G63, G64, G69, and G6*a* receive the same scan signal, and the scan lines G65, G66, G6*b*, and G6*c* receive the same scan signal. Thus, the pixels PX coupled to the scan lines G61, G62, G67, and G68 are turned on at the same time. At this time, the pixels PX in the first pixel row respectively receive the data signals D64 and D68, the pixels PX in the second pixel row respectively receive the data signals D65 and D69, the pixels PX in the seventh pixel row respectively receive the data signals D63 and D67, and the pixels PX in the eighth pixel row respectively receive the data signals D66 and D6*a*.

Thereafter, the pixels PX coupled to the scan lines G63, G64, G69, and G6*a* are turned on at the same time. At this time, the pixels PX in the third pixel row respectively receive the data signals D64 and D68, the pixels PX in the fourth pixel row respectively receive the data signals D65 and D69, the pixels PX in the ninth pixel row respectively receive the data signals D63 and D67, and the pixels PX in the tenth pixel row respectively receive the data signals D66 and D6*a*. Besides, the pixels PX coupled to the scan lines G65, G66, G6*b*, and G6*c* are turned on at the same time. At this time, the pixels PX in the fifth pixel row respectively receive the data signals D64 and D68, the pixels PX in the sixth pixel row respectively receive the data signals D65 and D69, the pixels PX in the eleventh pixel row respectively receive the data signals D63 and D67, and the pixels PX in the twelfth pixel row respectively receive the data signals D66 and D6*a*. Thereby, four pixel rows are turned on during the same scan period, so that the charge time of each pixel PX is prolonged and accordingly the pixel PX can display/reflect the correct grayscale.

For example, when the display panel 501 is a full HD display panel, 1080 scan lines are disposed in the display panel 501. In this case, the $1^{st}$-$540^{th}$ scan lines of the display panel 501 are considered a scan area, and two rows of the pixels coupled to the $1^{st}$-$540^{th}$ scan lines are turned on during each scan period. In addition, the $541^{st}$-$1080^{th}$ scan lines of the display panel 501 are considered another scan area, and two rows of the pixels coupled to the $541^{st}$-$1080^{th}$ scan lines are turned on during each scan period. Thus, four pixel rows are turned on during each scan period, so that the charge time of each pixel PX could be prolonged to four times of that in a conventional driving tehcnique.

Moreover, if the display panel 501 is driven through column inversion, the pixels PX coupled to the data lines S61-S69 and S6*a*-S6*c* do not adjoin each other and are respectively seperated by a pixel PX, and the pixels PX coupled to the data lines of the same group are located at different positions in different pixel columns. As shown in FIG. 6A, if the data signals D61-D64, D69, and D6*a*-D6*c* are positive and the data signals D65-D68 are negative during the current frame period, it is considered that the display panel 501 is driven through dot inversion. Besides, the polarity of the data signals D61-D69 and D6*a*-D6*c* are simply switched during the next frame period. Thus, during a frame period, the polarity of the data signals D61-D69 and D6*a*-D6*c* remains unchanged so that the power consumed for switching the polarity of the data signals is reduced and accordingly the power consumption of the entire display 500 is reduced.

Figure 7:
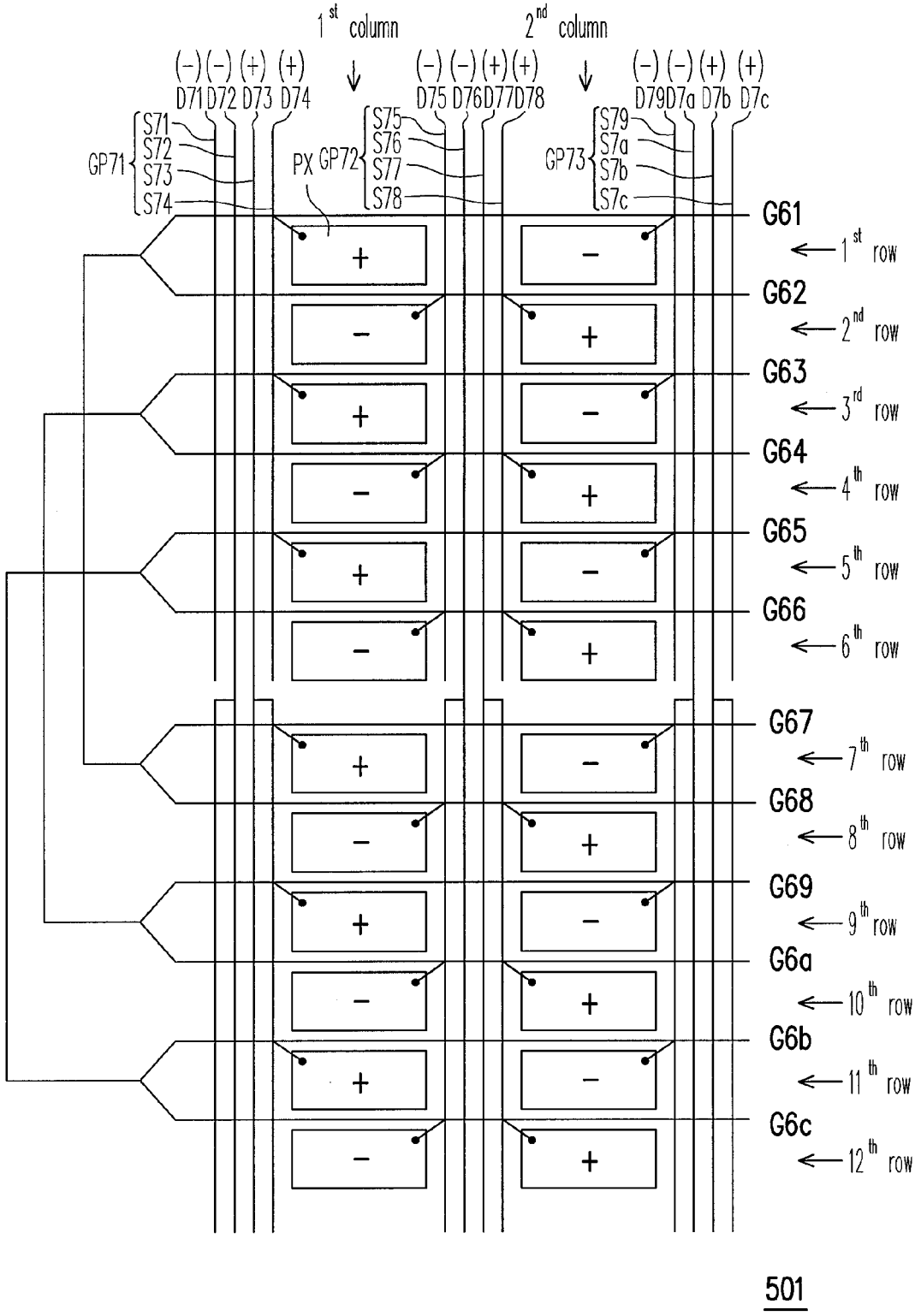
FIG. 7 is a diagram illustrating the structure of an LCD panel 501 according to yet still another embodiment of the present invention.

FIG. 7 is a diagram illustrating the structure of an LCD panel 501 according to yet still another embodiment of the present invention. Referring to both FIG. 6A and FIG. 7, the major difference between the two display panels 501 illustrated in FIG. 6A and FIG. 7 falls on the data lines S77-S79 and S7*a*, and the coupling (connection) relationship between the data lines S71-S76, S7*b*, and S7*c* and the pixels PX can be referred to the description about the data lines S61-S66, S6*b*, and S6*c* therefore will not be described herein. In the present embodiment, the data lines S71-S79 and S7*a*-S7*c* are grouped into groups GP71, GP72, and GP73. The group GP71 has data lines S71-S74, the group GP72 has data lines S75-S78, and the group GP73 has data lines S79 and S7*a*-S7*c*. The group GP72 is disposed between the first pixel column and the adjacent second pixel column.

In the present embodiment, the data line S77 crosses over the scan lines G61-G69 and G6*a*-G6*c* to receive a data signal D77 and transmit the data signal D77 to the even pixels in the $7^{th}$-$12^{th}$ rows of the second pixel column adjacent to the group GP72. The data lines S78 crosses over the scan lines G61-G66 to receive a data signal D78 and transmit the data signal D78 to the even pixels in the $1^{st}$-$6^{th}$ rows of the second pixel column. The data line S79 crosses over the scan lines G61-G66 to receive a data signal D79 and transmit the data signal D79 to the odd pixels in the $1^{st}$-$6^{th}$ rows of the second pixel column adjacent to the group GP73. The data line S7*a* crosses over the scan lines G61-G69 and G6*a*-G6*c* to receive a data signal D7*a* and transmit the data signal D7*a* to the odd pixels in the $7^{th}$-$12^{th}$ rows of the second pixel column. As shown in FIG. 7, the pixel structure illustrated in FIG. 7 is considered as mirror zigzag TFT arrangement. Namely, if the active devices (i.e. TFTs, not shown) of the pixels PX in a column are sequentially disposed as "left/right/left/right . . . " from top to bottom, the active devices (i.e. TFTs, not shown) of the pixels PX in the adjacent column are then symmetrically disposed as "right/left/right/left . . . " from top to bottom.

As described above, the even pixels in the $1^{st}$-$6^{th}$ rows of the second pixel column are directly coupled to the data line S78 to receive the data signal D78 and do not cross over the data lines S75-S77. The even pixels in the $7^{th}$-$12^{th}$ rows of the second pixel column are directly coupled to the data line S77 to receive the data signal D77 and do not cross over the data line S75, S76, and S78. The odd pixels in the $1^{st}$-$6^{th}$ rows of the second pixel column are directly coupled to the data line S79 to receive the data signal D79 and do not cross over the data lines S7*a*-S7*c*. The odd pixels in the $7^{th}$-$12^{th}$ rows of the second pixel column are directly coupled to the data line S7*a* to receive the data signal D7*a* and do not cross over the data line S79, S7*b*, and S7*c*. Thereby, lines (i.e. data lines) crossing can be avoided and thus reducing the crosstalk caused by cross-over capacitances.

Referring to FIG. 7 and FIG. 6B, first, the pixels PX coupled to the scan lines G61, G62, G67, and G68 are turned on at the same time. At this time, the pixels PX in the first pixel row respectively receive the data signals D74 and D79, the pixels PX in the second pixel row respectively receive the data signals D75 and D78, the pixels PX in the seventh pixel row respectively receive the data signals D73 and D7*a*, and the pixels PX in the eighth pixel row respectively receive the data signals D76 and D77. After that, the pixels PX coupled to the scan lines G63, G64, G69, and G6*a* are turned on at the same time. At this time, the pixels PX in the third pixel row respectively receive the data signals D74 and D79, the pixels PX in the fourth pixel row respectively receive the data signals D75 and D78, the pixels PX in the ninth pixel row respectively receive the data signals D73 and D7*a*, and the pixels PX in the tenth pixel row respectively receive the data signals D76 and D77. Moreover, the pixels PX coupled to the scan lines GG65, G66, G6*b*, and G6*c* are turned on at the same time. At this time, the pixels PX in the fifth pixel row respectively receive the data signals D74 and D79, the pixels PX in the sixth pixel row respectively receive the data signals D75 and D78, the pixels PX in the eleventh pixel row respectively receive the data signals D73 and D7*a*, and the pixels PX in the twelfth pixel row respectively receive the data signals D76 and D77. Thereby, four pixel rows are turned on during the same scan period, so that the charge time of each pixel PX is prolonged and accordingly the pixel PX can display/reflect the correct grayscale.

Additionally, based on the coupling (connection) relationship between the pixels PX and the data lines S71-S79 and S7*a*-S7*c*, if the data signals D73, D74, D77, D78, D7*b*, and D7*c* are positive and the data signals D71, D72, D75, D76, D79, and D7*a* are negative during the current frame period, it is considered that the display panel 501 is driven through dot inversion. Besides, the polarity of the data signals D71-D79 and D7*a*-D7*c* is simply switched during the next frame period. Thus, during a frame period, the polarity of the data signals D71-D79 and D7*a*-D7*c* remains unchanged so that the power consumed for switching the polarity of the data signals is reduced and accordingly the power consumption of the entire display 500 is reduced.

Figure 8:
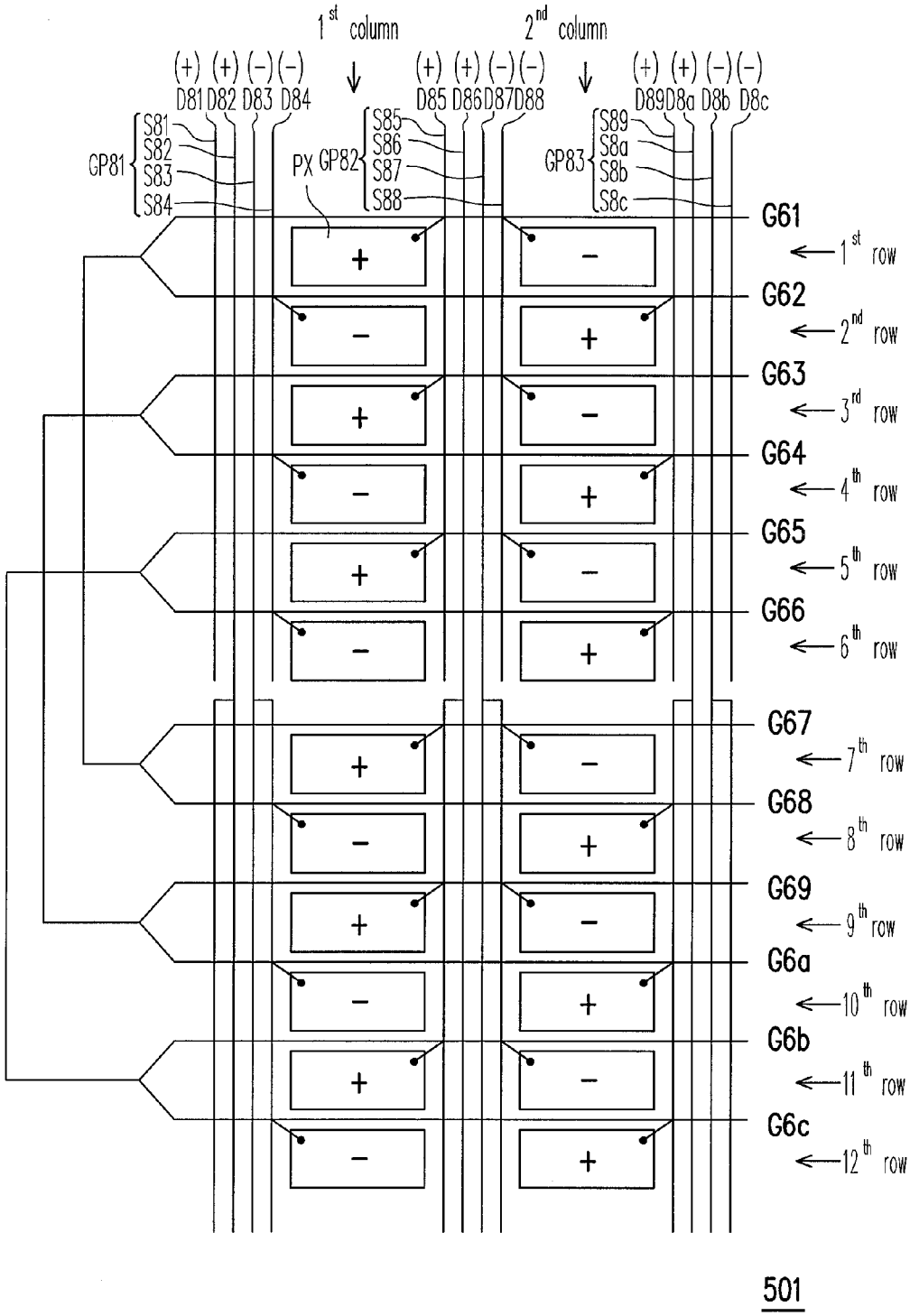
FIG. 8 is a diagram illustrating the structure of an LCD panel 501 according to still another embodiment of the present invention.

FIG. 8 is a diagram illustrating the structure of an LCD panel 501 according to still another embodiment of the present invention. Referring to both FIG. 6A and FIG. 8, the major difference between the two display panels 501 illustrated in FIG. 6A and FIG. 8 falls on the data lines S83-S86, and the coupling (connection) relationship between the data lines S81, S82, S87-S89, and S8*a*-S8*c* and the pixels PX can be referred to the description about the data lines S61, S62, S67-S69, and S6*a*-S6*c* therefore will not be described herein. In the present embodiment, the data lines S81-S89 and S8*a*-S8*c* are grouped into groups GP81, GP82, and GP83. The group GP81 has the data lines S81-S84, the group GP82 has the data lines S85-S88, and the group GP83 has the data lines S89 and S8*a*-S8*c*. The group GP82 is disposed between the first pixel column and the adjacent second pixel column.

In the present embodiment, the data line S83 crosses over the scan lines G61-G69 and G6*a*-G6*c* to receive a data signal D83 and transmit the data signal D83 to the even pixels in the $7^{th}$-$12^{th}$ rows of the first pixel column adjacent to the group GP81. The data line S84 crosses over the scan lines G61-G66 to receive a data signal D84 and transmit the data signal D84 to the even pixels in the $1^{st}$-$6^{th}$ rows of the first pixel column. The data line S85 crosses over the scan lines G61-G66 to receive a data signal D85 and transmit the data signal D85 to the odd pixels in the $1^{st}$-$6^{th}$ rows of the first pixel column adjacent to the group GP82. The data line S86 crosses over the scan lines G61-G69 and G6*a*-G6*c* to receive a data signal D86 and transmit the data signal D86 to the odd pixels in the $7^{th}$-$12^{th}$ rows of the first pixel column. As shown in FIG. 8, the pixel structure illustrated in FIG. 8 is considered another mirror zigzag TFT arrangement.

As described above, the even pixels in the $1^{st}$-$6^{th}$ rows of the first pixel column are directly coupled to the data line S84 to receive the data signal D84 and do not cross over the data lines S81-S83. The even pixels in the $7^{th}$-$12^{th}$ rows of the first pixel column are directly coupled to the data line S83 to receive the data signal D83 and do not cross over the data line S81, S82, and S84. The odd pixels in the $1^{st}$-$6^{th}$ rows of the first pixel column are directly coupled to the data line S85 to receive the data signal D85 and do not cross over the data lines S86-S88. The odd pixels in the $7^{th}$-$12^{th}$ rows of the first pixel column are directly coupled to the data line S86 to receive the data signal D86 and do not cross over the data line S86, S87, and S88. Thereby, lines (i.e. data lines) crossing can be avoided and thus reducing the crosstalk caused by cross-over capacitances.

Referring to FIG. 8 and FIG. 6B, first, the pixels PX coupled to the scan lines G61, G62, G67, and G68 are turned on at the same time. At this time, the pixels PX in the first pixel row respectively receive the data signals D85 and D88, the pixels PX in the second pixel row respectively receive the data signals D84 and D89, the pixels PX in the seventh pixel row respectively receive the data signals D86 and D87, and the pixels PX in the eighth pixel row respectively receive the data signals D83 and D8*a*. After that, the pixels PX coupled to the scan lines G63, G64, G69, and G6*a* are turned on at the same time. At this time, the pixels PX in the third pixel row respectively receive the data signals D85 and D88, the pixels PX in the fourth pixel row respectively receive the data signals D84 and D89, the pixels PX in the ninth pixel row respectively receive the data signals D86 and D87, and the pixels PX in the tenth pixel row respectively receive the data signals D83 and D8*a*. Moreover, the pixels PX coupled to the scan lines GG65, G66, G6*b*, and G6*c* are turned on at the same time. At this time, the pixels PX in the fifth pixel row respectively receive the data signals D85 and D88, the pixels PX in the sixth pixel row respectively receive the data signals D84 and D89, the pixels PX in the eleventh pixel row respectively receive the data signals D86 and D87, and the pixels PX in the twelfth pixel row respectively receive the data signals D83 and D8*a*. Thereby, four pixel rows are turned on during the same scan period, so that the charge time of each pixel PX is prolonged and accordingly the pixel PX can display/reflect the correct grayscale.

Additionally, based on the coupling (connection) relationship between the pixels PX and the data lines S81-S89 and S8*a*-S8*c*, if the data signals D81, D82, D85, D86, D89, and D8*a* are positive and the data signals D83, D84, D87, D88, D8*b*, and D8*c* are negative during the current frame period, it is considered that the display panel 501 is driven through dot inversion. Besides, the polarity of the data signals D81-D89 and D8*a*-D8*c* is simply switched during the next frame period. Thus, during a frame period, the polarity of the data signals D81-D89 and D8*a*-D8*c* remains unchanged so that the power consumed for switching the polarity of the data signals is reduced and accordingly the power consumption of the entire display 500 is reduced.

In summary, embodiments of the present invention provide a display and a display panel thereof, wherein all the pixels in each pixel column are respectively coupled to a plurality of data lines, so that multiple pixel rows can be turned on at the same time during each scan period, and accordingly the charge time of each pixel can be prolonged. In addition, since each data line does not cross over any pixel, the crosstalk caused by cross-over capacitances also can be reduced. Moreover, since the pixels coupled to each data line do not adjoin each other, the data signal received by the data line remains unchanged during a frame period. Accordingly, the power consumption of the entire display can be reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display panel, comprising:

a plurality of scan lines;

a plurality of data lines, disposed substantially perpendicular to the scan lines; and a plurality of pixels, each of the pixels being electrically connected to the correpsonding data line and the corresponding scan line and the pixels being arranged as an array, wherein the data lines are grouped into a plurality of groups, each of the groups is disposed between two adjacent pixel columns and has N data lines, a portion of the data lines of at least a first group among the groups cross over only a protion of the scan lines, and the rest data lines of the first group cross over all the scan lines, where N is a positive integer greater than or equal to 3, wherein the first group comprises a first data line, a second data line, and a third data line when N is 3, wherein the first data line crosses over the portion of the scan lines to receive a first data signal and transmit the first data signal to a portion of even pixels in a first pixel column of the two adjacent pixel columns corresponding to the first group, wherein the second data line crosses over the portion of the scan lines to receive a second data signal and transmit the second data signal to a portion of odd pixels in a second pixel column of the two ajdacent pixel columns corresponding to the first group, and wherein the third data line crosses over all the scan lines to receive a third data signal and transmit the third data signal to the rest even pixels in the first pixel column and the rest odd pixels in the second pixel column.

2. The display panel according to claim 1, wherein:

the portion of the even pixels in the first pixel column do not cross over the second data line and the third data line to receive the first data signal, the portion of the odd pixels in the second pixel column do not cross over the first data line and the third data line to receive the second data signal, and the rest even pixels in the first pixel column and the rest odd pixels in the second pixel column do not cross over the first data line and the second data line to receive the third data signal.

3. The display panel according to claim 1, wherein the $i^{th}$ scan line is electrically connected to all the pixels in an $i^{th}$ pixel row to correspondingly receive a scan signal, where i is a positive integer.

4. A display panel, comprising:

a plurality of scan lines;

a plurality of data lines, disposed substantially perpendicular to the scan lines; and a plurality of pixels, each of the pixels being electrically connected to the correpsonding data line and the corresponding scan line and the pixels being arranged as an array, wherein the data lines are grouped into a plurality of groups, each of the groups is disposed between two adjacent pixel columns and has N data lines, a portion of the data lines of at least a first group among the groups cross over only a protion of the scan lines, and the rest data lines of the first group cross over all the scan lines, where N is a positive integer greater than or equal to 3, wherein the first group comprises a first data line, a second data line, a third data line, and a fourth data line when N is 4, wherein the first data line crosses over the portion of the scan lines to receive a first data signal and transmit the first data signal to a portion of even pixels in a first pixel column of the two adjacent pixel columns correspondign to the first group, wherein the second data line crosses over the portion of the scan lines to receive a second data signal and transmit the second data signal to a portion of odd pixels in a second pixel column of the two adjacent pixel columns corresponding to the first group, wherein the third data line crosses over all the scan lines to receive a third data signal and transmit the third data signal to the rest even pixels in the first pixel column, and wherein the fourth data line crosses over all the scan lines to receive a fourth data signal and transmit the fourth data signal to the rest odd pixels in the second pixel column.

5. The display panel according to claim 4, wherein:

the portion of the even pixels in the first pixel column do not cross over the second data line, the third data line, and the fourth data line to receive the first data signal, the portion of the odd pixels in the second pixel column do not cross over the first data line, the third data line, and the fourth data line to receive the second data signal, the rest even pixels in the first pixel column do not cross over the first data line, the second data line, and the fourth data line to receive the third data signal, and the rest odd pixels in the second pixel column do not cross over the first data line, the second data line, and the third data line to receive the fourth data signal.

6. A display panel, comprising:

a plurality of scan lines;

a plurality of data lines, disposed substantially perpendicular to the scan lines; and a plurality of pixels, each of the pixels being electrically connected to the correpsonding data line and the corresponding scan line and the pixels being arranged as an array, wherein the data lines are grouped into a plurality of groups, each of the groups is disposed between two adjacent pixel columns and has N data lines, a portion of the data lines of at least a first group among the groups cross over only a protion of the scan lines, and the rest data lines of the first group cross over all the scan lines, where N is a positive integer greater than or equal to 3, wherein the first groupcomprises a first data line, a second data line, a third data line, and a fourth data line when N is 4, wherein the first data line crosses over the portion of the scan lines to receive a first data signal and transmit the first data signal to a portion of even pixels in a first pixel column of the two adjacent pixel columns corresponding to the first group, wherein the second data line crosses over the portion of the scan lines to receive a second data signal and transmit the second data signal to a portion of even pixels in a second pixel column of the two adjacent pixel columns correpsonding to the first group, wherein the third data line crosses over all the scan lines to receive a third data signal and transmit the third data signal to the rest even pixels in the first pixel column, and wherein the fourth data line crosses over all the scan lines to receive a fourth data signal and transmit the fourth data signal to the rest even pixels in the second pixel column.

7. The display panel according to claim 6, wherein:

the portion of the even pixels in the first pixel column do not cross over the second data line, the third data line, and the fourth data line to receive the first data signal, the portion of the even pixels in the second pixel column do not cross over the first data line, the third data line, and the fourth data line to receive the second data signal, the rest even pixels in the first pixel column do not cross over the first data line, the second data line, and the fourth data line to receive the third data signal, and the rest even pixels in the second pixel column do not cross over the first data line, the second data line, and the third data line to receive the fourth data signal.

8. A display panel, comprising:

a plurality of scan lines;

a plurality of data lines, disposed substantially perpendicular to the scan lines; and a plurality of pixels, each of the pixels being electrically connected to the correpsonding data line and the corresponding scan line and the pixels being arranged as an array, wherein the data lines are grouped into a plurality of groups, each of the groups is disposed between two adjacent pixel columns and has N data lines, a portion of the data lines of at least a first group among the groups cross over only a protion of the scan lines, and the rest data lines of the first group cross over all the scan lines, where N is a positive integer greater than or equal to 3, wherein the first group comprises a first data line, a second data line, a third data line, and a fourth data line when N is 4, wherein the first data line crosses over the portion of the scan lines to receive a first data signal and transmit the first data signal to a portion of odd pixels in a first pixel column of the two adjacent pixel columns corresponding to the first group, wherein the second data line crosses over the portion of the scan lines to receive a second data signal and transmit the second data signal to a portion of odd pixels in a second pixel column of the two ajdacent pixel columns corresponding to the first group, wherein the third data line crosses over all the scan lines to receive a third data signal and transmit the third data signal to the rest odd pixels in the first pixel column, and wherein the fourth data line crosses over all the scan lines to receive a fourth data signal and transmit the fourth data signal to the rest odd pixels in the second pixel column.

9. The display panel according to claim 8, wherein:

the portion of the odd pixels in the first pixel column do not cross over the second data line, the third data line, and the fourth data line to receive the first data signal, the portion of the odd pixels in the second pixel column do not cross over the first data line, the third data line, and the fourth data line to receive the second data signal, the rest odd pixels in the first pixel column do not cross over the first data line, the second data line, and the fourth data line to receive the third data signal, and the rest odd pixels in the second pixel column do not cross over the first data line, the second data line, and the third data line to receive the fourth data signal.

* * * * *